US008121506B2

(12) United States Patent
Takahashi et al.

(10) Patent No.: US 8,121,506 B2
(45) Date of Patent: Feb. 21, 2012

(54) IMAGE FORMING APPARATUS

(75) Inventors: Masaaki Takahashi, Kanagawa (JP); Taku Fukuhara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 395 days.

(21) Appl. No.: 12/555,855

(22) Filed: Sep. 9, 2009

(65) Prior Publication Data

US 2010/0196032 A1 Aug. 5, 2010

(30) Foreign Application Priority Data

Feb. 3, 2009 (JP) ..... 2009-022752

(51) Int. Cl.
*G03G 15/16* (2006.01)

(52) U.S. Cl. ..... 399/66

(58) Field of Classification Search ..... 399/66, 399/48, 297, 310, 313, 314
See application file for complete search history.

(56) References Cited

U.S. PATENT DOCUMENTS 6,253,038 B1 6/2001 Ito et al.
6,763,203 B2 * 7/2004 Yoshioka et al. ..... 399/66
2001/0031160 A1 * 10/2001 Tanaka ..... 399/310

FOREIGN PATENT DOCUMENTS

JP 2000-147849 5/2000
JP 2003215887 A * 7/2003
JP 2007011076 A * 1/2007
JP 2007-052149 3/2007

* cited by examiner

*Primary Examiner* — Susan Lee
(74) *Attorney, Agent, or Firm* — Fildes & Outland, P.C.

(57) ABSTRACT

An image forming apparatus includes: an image carrier that carries a developed image that has been developed on a surface thereof using a developer; a transfer member that transfers the developed image from the image carrier to a belt-shaped member; an electric power supply unit that supplies electric power to the transfer member; a measurement unit that measures a combined resistance value of the image carrier, the belt-shaped member, and the transfer member; and a controller that controls the electric power supply unit. The controller controls the electric power supply unit such that the electric power supplied to the transfer member is changed from a predetermined first supply value to a second supply value, the second supply value being larger than the first supply value, when the combined resistance value measured by the measurement unit is lower than a predetermined combined resistance value.

7 Claims, 4 Drawing Sheets

IMAGE FORMING APPARATUS

CROSS-REFERENCE TO RELATED APPLICATION

This application is based on and claims priority under 35 USC 119 from Japanese Patent Application No. 2009-022752 filed on Feb. 3, 2009.

BACKGROUND

Technical Field

The present invention relates to an image forming apparatus.

SUMMARY

A first aspect of the present invention is an image forming apparatus including: an image carrier that carries a developed image that has been developed on a surface thereof using a developer; a transfer member that transfers the developed image from the image carrier to a belt-shaped member; an electric power supply unit that supplies electric power to the transfer member; a measurement unit that measures a combined resistance value of the image carrier, the belt-shaped member, and the transfer member; and a controller that controls the electric power supply unit such that the electric power supplied to the transfer member is changed from a predetermined first supply value to a second supply value, the second supply value being larger than the first supply value, when the combined resistance value measured by the measurement unit is lower than a predetermined combined resistance value.

BRIEF DESCRIPTION OF THE DRAWINGS

Exemplary embodiments of the present invention will be described in detail based on the following figures, wherein.

DETAILED DESCRIPTION

An exemplary embodiment of the invention will be described below with reference to the drawings.

Figure 1:
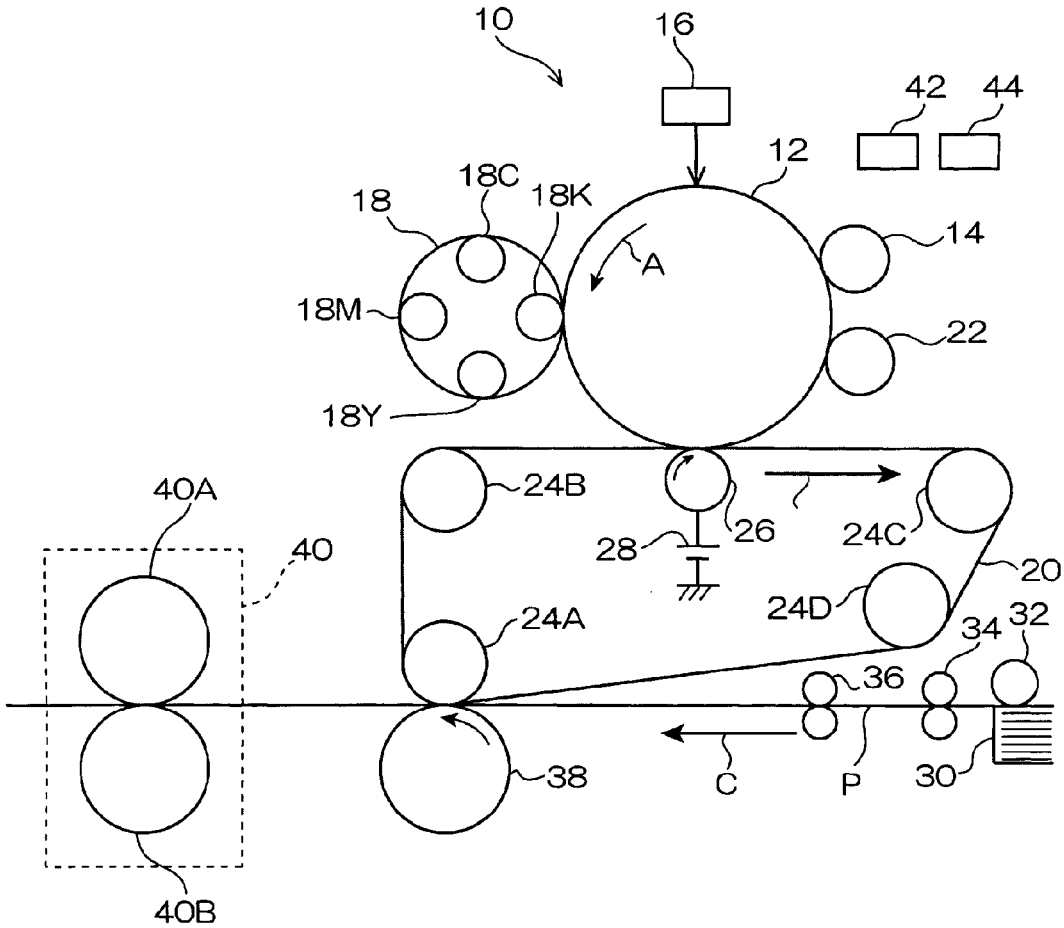
FIG. 1 is a side view illustrating a schematic configuration of a main part of an image forming apparatus according to an exemplary embodiment of the invention.

FIG. 1 is a side view illustrating a schematic configuration of a main part of an image forming apparatus 10 according to an exemplary embodiment of the invention.

Referring to FIG. 1, the image forming apparatus 10 includes a photoreceptor drum 12 that is rotated in a direction of an arrow A, i.e., in a slow scanning direction at a predetermined rotating speed by a motor (not illustrated). A charger 14 is provided in an outer circumferential surface of the photoreceptor drum 12 while being in contact with the outer circumferential surface. The charger 14 charges the outer circumferential surface.

A laser beam scanning device 16 is disposed further downstream side of the photoreceptor drum 12 in the direction of the arrow A than the charger 14. The laser beam scanning device 16 modulates a laser beam emitted from a light source according to an image to be formed, and the laser beam scanning device 16 deflects the laser beam in a fast scanning direction to scan the outer circumferential surface of the photoreceptor drum 12 in parallel with an axis line of the photoreceptor drum 12, thereby forming an electrostatic latent image on the outer circumferential surface of the photoreceptor drum 12.

A development device 18 is disposed further downstream side of the photoreceptor drum 12 in the direction of the arrow A than the laser beam scanning device 16. The development device 18 includes a roller-shaped storage body that is rotatably disposed. Four storage portions corresponding to yellow (Y), magenta (M), cyan (C), and black (K) colors are formed in the storage body, and development sections 18Y, 18M, 18C, and 18K are provided in the storage portions. The development sections 18Y, 18M, 18C, and 18K include development rollers (not illustrated), and Y, M, C, and K color toners are stored in the development sections 18Y, 18M, 18C, and 18K. An erasing and cleaning device 22 is disposed on the opposite side of the photoreceptor drum 12 to the development device 18. The erasing and cleaning device 22 has a function of erasing electricity in the outer circumferential surface of the photoreceptor drum 12 and a function of removing unnecessary toner remaining on the outer circumferential surface thereof.

In the image forming apparatus 10 of the exemplary embodiment, the color image is formed while the photoreceptor drum 12 is rotated four revolutions. That is, in a period during which the photoreceptor drum 12 is rotated four revolutions, the charger 14 continuously charges the outer circumferential surface of the photoreceptor drum 12, the erasing and cleaning device 22 continuously erases (removes) the electricity from the outer circumferential surface, and the laser beam scanning device 16 repeatedly scans the outer circumferential surface of the photoreceptor drum 12 with the laser beam that is modulated according to one of the Y, M, C, and K items of image information expressing the color image to be formed while switching the image information used for the modulation of the laser beam every one revolution of the photoreceptor drum 12. While the development roller of one of the development sections 18Y, 18M, 18C, and 18K is in contact with the outer circumferential surface of the photoreceptor drum 12, the development device 18 actuates the development section that is in contact with the outer circumferential surface to develop the electrostatic latent image formed on the outer circumferential surface of the photoreceptor drum 12 with a specific color, and the development device 18 forms a specific toner image on the outer circumferential surface of the photoreceptor drum 12. The development device 18 repeats the image formation while the development section used in the development of the electrostatic latent image is switched every one revolution of the photoreceptor drum 12.

Therefore, the Y, M, C, and K toner images are sequentially formed on the outer circumferential surface of the photoreceptor drum 12 while superimposed on one another every revolution of the photoreceptor drum 12, and the color toner image is formed on the outer circumferential surface of the photoreceptor drum 12 after the photoreceptor drum 12 is rotated four revolutions.

An endless intermediate transfer belt 20 is provided below the photoreceptor drum 12. The intermediate transfer belt 20 is entrained about rollers 24A, 24B, 24C, and 24D, and the endless intermediate transfer belt 20 is disposed such that an outer circumferential surface of the endless intermediate transfer belt 20 is in contact with the outer circumferential surface of the photoreceptor drum 12. The rollers 24A, 24B, 24C, and 24D are rotated by the torque of a motor (not illustrated) being transmitted and rotate the intermediate transfer belt 20 in a direction of an arrow B.

A primary transfer roller 26 is disposed at the opposite side of the intermediate transfer belt 20 to the photoreceptor drum 12. The primary transfer roller 26 presses the intermediate transfer belt 20 against the outer circumferential surface of the photoreceptor drum 12.

A transfer power supply 28 is provided in the image forming apparatus 10, and the transfer power supply 28 supplies an electric power to the primary transfer roller 26 in order to transfer the toner image on the photoreceptor drum 12 to the intermediate transfer belt 20.

Accordingly, the transfer power supply 28 supplies the electric power to the primary transfer roller 26, and the primary transfer roller 26 presses the intermediate transfer belt 20 against the outer circumferential surface of the photoreceptor drum 12, whereby the toner image formed on the outer circumferential surface of the photoreceptor drum 12 is transferred to an image forming surface of the intermediate transfer belt 20. When the toner image formed on the outer circumferential surface of the photoreceptor drum 12 is transferred to the intermediate transfer belt 20, the erasing and cleaning device 22 cleans a region where the transferred toner image is held in the outer circumferential surface of the photoreceptor drum 12.

A sheet storage 30 is disposed below the intermediate transfer belt 20, and many stacked sheets P that are of a recording medium are stored in the sheet storage 30. In the drawing, a feed roller 32 is disposed at the upper left on the sheet storage 30, and pairs of rollers 34 and 36 are disposed at the downstream side in a direction in which the feed roller 32 feeds the sheet P. The uppermost sheet P in the stacked state is fed from the sheet storage 30 by the rotation of the feed roller 32, and the sheet P is transported by the pairs of rollers 34 and 36.

A secondary transfer roller 38 is disposed at the opposite side of the intermediate transfer belt 20 to the roller 24A, and the secondary transfer roller 38 presses the intermediate transfer belt 20 against the outer circumferential surface of the roller 24A. The sheet P transported by the pairs of rollers 34 and 36 is delivered between the intermediate transfer belt 20 and secondary transfer roller 38, and the secondary transfer roller 38 transfers the toner image formed on the image forming surface of the intermediate transfer belt 20 to the sheet P. As with the primary transfer roller 26, a transfer electric power is supplied to the secondary transfer roller 38.

A fixing device 40 is disposed further downstream in the sheet transporting direction (direction of an arrow C of FIG. 1) than the secondary transfer roller 38. The fixing device 40 includes a heating roller 40A that heats the toner image on the sheet P and a roller 40B that is pressed against the heating roller 40A. When the sheet P is passed through a nip part between the heating roller 40A and the roller 40B, the toner image is fused and solidified, and therefore the toner image is fixed to the sheet P. Then, a sheet exit roller (not illustrated) transports the sheet P to the outside of the image forming apparatus 10. The sheet exit roller is disposed further downstream in the sheet transporting direction than the fixing device 40.

The image forming apparatus 10 includes a temperature sensor 42 that measured a temperature in a space of the apparatus and a humidity sensor 44 that measures humidity in the space of the apparatus. In the image forming apparatus 10 of the exemplary embodiment, a thermistor is used as the temperature sensor 42. Alternatively, other temperature sensors such as a platinum resistance thermometer and a thermocouple may obviously be used as the temperature sensor 42. In the image forming apparatus 10 of the exemplary embodiment, a polymer-membrane humidity sensor is used as the humidity sensor 44. Alternatively, other humidity sensors such as a ceramic humidity sensor and an electrolytic humidity sensor may obviously be used as the humidity sensor 44.

Figure 2:
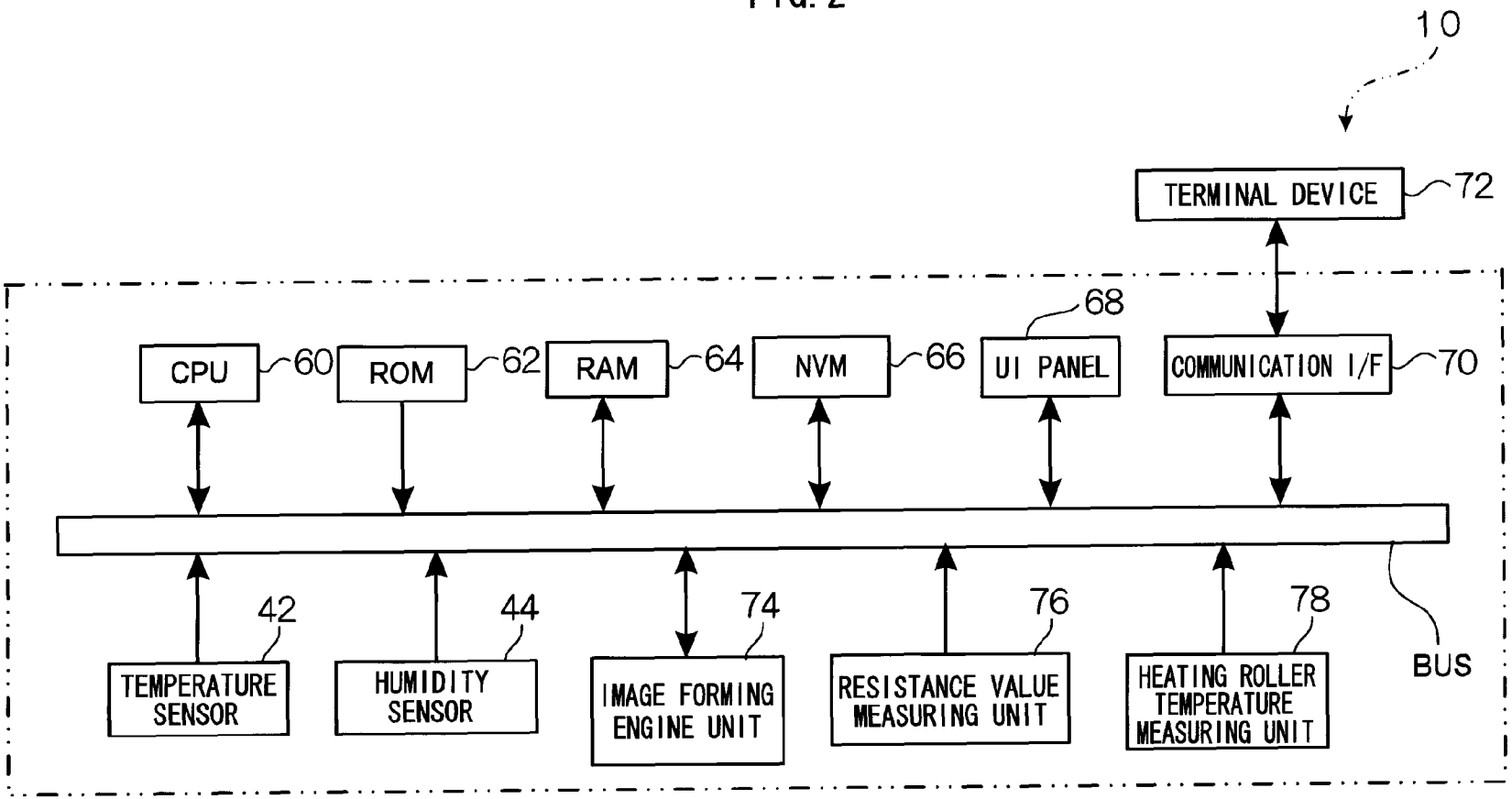
FIG. 2 is a block diagram illustrating a configuration of a main part of an electric system in the image forming apparatus of the exemplary embodiment.

FIG. 2 is a block diagram illustrating a configuration of a main part of an electric system in the image forming apparatus 10 of the exemplary embodiment.

Referring to FIG. 2, the image forming apparatus 10 includes CPU (Central Processing Unit) 60, ROM (Read Only Memory) 62, RAM (Random Access Memory) 64, NVM (Non Volatile Memory) 66, a UI (User Interface) screen 68, and a communication interface 70.

CPU 60 controls the whole operation of the image forming apparatus 10. ROM 62 acts as a storage device in which a control program for controlling actuation of the image forming apparatus 10, a transfer defect suppressing process program (described later), and various parameters are previously stored. RAM 64 is used as a work area in executing various programs. Various kinds of information that should be retained even if the power of the apparatus is turned off are stored in NVM 66.

The UI screen 68 includes a touch screen display or the like in which a transparent touch screen is laminated on a display. Various kinds of information are displayed on a display surface of the display, and a user can input desired information or a desired instruction by touching the touch screen display.

The communication interface 70 is connected to a terminal device 72 such as a personal computer, and the communication interface 70 receives various kinds of information such as image information expressing the image formed on the sheet P from the terminal device 72.

CPU 60, ROM 62, RAM 64, NVM 66, the UI screen 68, and the communication interface 70 are connected to one another through a system bus BUS. Accordingly, CPU 60 accesses ROM 62, RAM 64, and NVM 66, displays various kinds of information on the UI screen 68, obtains contents of an instruction provided at the UI screen 68 by the user, and receives various kinds of information from the terminal device 72 through the communication interface 70.

The image forming apparatus 10 includes an image forming engine unit 74 that forms the image on the sheet P by a xerographic system. The image forming engine unit 74 includes the photoreceptor drum 12, the charger 14, the laser beam scanning device 16, the development device 18, the erasing and cleaning device 22, the rollers 24A, 24B, 24C, and 24D, the primary transfer roller 26, the transfer power supply 28, the pairs of rollers 34 and 36, the secondary transfer roller 38, the fixing device 40, and the motors (not illustrated) that drive the rollers.

The image forming engine unit 74 is also connected to the system bus BUS. Accordingly, CPU 60 controls the actuation of the image forming engine unit 74.

The image forming apparatus 10 includes a resistance value measuring unit 76 and a heating roller temperature measuring unit 78. The resistance value measuring unit 76 measures a combined resistance value of the photoreceptor drum 12, the intermediate transfer belt 20, and the primary transfer roller 26. The heating roller temperature measuring unit 78 measures a temperature of the heating roller 40A. The resistance value measuring unit 76 and the heating roller temperature measuring unit 78 are also connected to the system bus BUS. The temperature sensor 42 and the humidity sensor 44 are also connected to the system bus BUS. Accordingly, CPU 60 obtains the combined resistance value measured by the resistance value measuring unit 76, the temperatures measured by the temperature sensor 42 and the heating roller temperature measuring unit 78, and the humidity measured by the humidity sensor 44.

Action of the image forming apparatus 10 of the exemplary embodiment will be described below. First, a process flow of the image forming engine unit 74 will briefly be described.

The charger 14 charges the outer circumferential surface of the photoreceptor drum 12, and the photoreceptor drum 12 and the intermediate transfer belt 20 are rotated. Then the laser beam scanning device 16 forms the electrostatic latent image on the photoreceptor drum 12. The development device 18 supplies the toner to the electrostatic latent image, thereby developing the electrostatic latent image to obtain the toner image. The photoreceptor drum 12 conveys the toner image to a contact position (primary transfer position) with the intermediate transfer belt 20.

The transfer power supply 28 supplies the electric power to the primary transfer roller 26, and the primary transfer roller 26 presses the intermediate transfer belt 20 against the outer circumferential surface of the photoreceptor drum 12, thereby transferring the toner image on the photoreceptor drum 12 to the image forming surface of the intermediate transfer belt 20. That is, the toner image is conveyed by the photoreceptor drum 12 rotated in the direction of arrow A of FIG. 1, and the toner image is transferred to the outer circumferential surface of the intermediate transfer belt 20. The toner image conveyed in the direction of the arrow B by the intermediate transfer belt 20 is transferred to the sheet P in a contact position (secondary transfer position) with the secondary transfer roller 38, and the fixing device 40 fixes the toner image onto the sheet P.

When the image forming apparatus 10 forms the images for a long time to leave the intermediate transfer belt 20 in a high-temperature and high-humidity environment for a long time, a discharge product, such as nitrogen oxide and ozone, adhering to an inner circumferential surface (back side) of the intermediate transfer belt 20 absorbs moisture in air to deliquesces, and an electric resistance value on the inner circumferential surface of the intermediate transfer belt 20 is temporarily decreased. In such cases, a current passing through the primary transfer roller 26 temporarily becomes excessive, and there is a risk of a transfer defect being generated. When the inside of the image forming apparatus 10 is dried by heat generated from the member such as the heating roller 40A having a heat source, the electric resistance value at the inner circumferential surface of the intermediate transfer belt 20 is returned to the original state. However, the transfer defect is inevitable until the electric resistance value is returned to the original state.

Therefore, in the image forming apparatus 10 of the exemplary embodiment, a transfer defect suppressing process is performed to suppress the transfer defect caused by the temporal decrease of the electric resistance value at the inner circumferential surface of the intermediate transfer belt 20 when the toner image is transferred from the photoreceptor drum 12 to the intermediate transfer belt 20.

Figure 3:
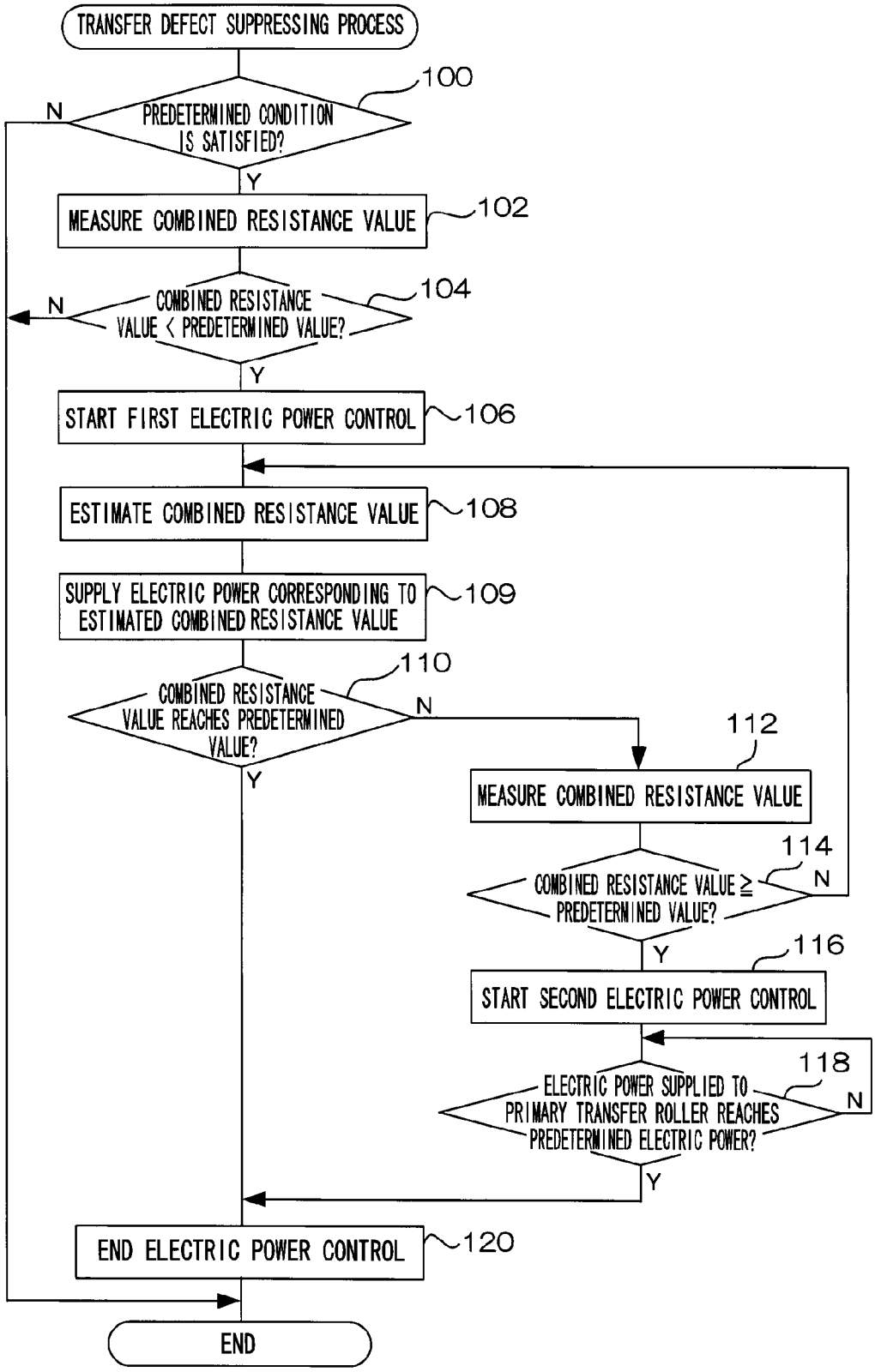
FIG. 3 is a flowchart illustrating a flow of a transfer defect suppressing process program of the exemplary embodiment.

The operation of the image forming apparatus 10 in performing the transfer defect suppressing process during the image formation will be described with reference to FIG. 3. FIG. 3 is a flowchart illustrating a flow of a transfer defect suppressing process program that is executed at predetermined time intervals (for example, every 0.5 second) by CPU 60 of the image forming apparatus 10 when the image forming engine unit 74 performs the image forming process. The transfer defect suppressing process program is previously stored in a predetermined region of ROM 62.

Referring to FIG. 3, in Step 100, assuming that the discharge product adhering to the inner circumferential surface of the intermediate transfer belt 20 deliquesces, it is determined whether or not predetermined conditions are satisfied. When the predetermined conditions are satisfied, the flow goes to Step 102. When the predetermined conditions are not satisfied, the transfer defect suppressing process program is ended.

In the image forming apparatus 10 of the exemplary embodiment, assuming that the discharge product adhering to the inner circumferential surface of the intermediate transfer belt 20 deliquesces, the predetermined conditions are obtained from an experiment in which the real machine of the image forming apparatus 10 is used or a computer simulation based on design specifications of the image forming apparatus 10. Specifically, the predetermined conditions are as follows: the temperature of the heating roller 40A is equal to or lower than a predetermined temperature (for example, 40° C.), the temperature measured by the sensor 42 is equal to or more than a predetermined temperature (for example, 28° C.), the humidity measured by the humidity sensor 44 is equal to or more than predetermined humidity (for example, 70%), and an accumulative transfer amount of toner image transferred from the photoreceptor drum 12 to the intermediate transfer belt 20 reaches a predetermined amount (for example, 500000 images). However, any condition may be applied as long as the discharge product adhering to the inner circumferential surface of the intermediate transfer belt 20 deliquesces.

In Step 102, the resistance value measuring unit 76 measures the combined resistance value of the photoreceptor drum 12, intermediate transfer belt 20, and primary transfer roller 26. In the exemplary embodiment, a predetermined voltage is applied among the photoreceptor drum 12, intermediate transfer belt 20, and primary transfer roller 26, a current passing through the photoreceptor drum 12, intermediate transfer belt 20, and primary transfer roller 26 is measured, and a resistance value computed based on the measured current and the applied voltage is set to the combined resistance value of the photoreceptor drum 12, intermediate transfer belt 20, and primary transfer roller 26. Alternatively, the resistance values of the photoreceptor drum 12, intermediate transfer belt 20, and primary transfer roller 26 are separately measured and the combined resistance value may be computed based on the resistance values thereof.

In Step 104, it is determined whether or not the combined resistance value measured by the resistance value measuring unit 76 in Step 102 is lower than a predetermined combined resistance value. When the combined resistance value is lower than the predetermined combined resistance value, the flow goes to Step 106. When the combined resistance value is not lower than the predetermined combined resistance value, the transfer defect suppressing process program is ended.

In the exemplary embodiment, a value previously obtained from the experiment in which the real machine of the image forming apparatus 10 is used or the computer simulation based on design specifications of the image forming apparatus 10 is used as the predetermined combined resistance value in which the transfer defect is not generated when the toner image is transferred from the photoreceptor drum 12 to the intermediate transfer belt 20.

In Step 106, the control of the transfer power supply 28 is started such that the electric power supplied to the primary transfer roller 26 is gradually increased from an electric power smaller than a predetermined electric power (first supply value) to the predetermined electric power (second supply value) (hereinafter the control is referred to as "first electric power control").

In the exemplary embodiment, assuming that the toner imaged is well transferred from the photoreceptor drum 12 to the intermediate transfer belt 20 while the decrease of the electric resistance value caused by the deliquescence of the discharge product adhering to the inner circumferential surface of the intermediate transfer belt 20 is not generated in the inner circumferential surface of the intermediate transfer belt 20, an electric power previously obtained from the experiment in which the real machine of the image forming apparatus 10 is used or the computer simulation based on design specifications of the image forming apparatus 10 is used as the predetermined electric power.

In Step 108, the combined resistance value of the photoreceptor drum 12, intermediate transfer belt 20, and primary transfer roller 26 is estimated. In the exemplary embodiment, the combined resistance value of the photoreceptor drum 12, intermediate transfer belt 20, and primary transfer roller 26 is estimated based on the accumulative transfer amount of toner image transferred from the photoreceptor drum 12 to the intermediate transfer belt 20. That is, information indicating a correspondence relationship between the accumulative transfer amount of toner image transferred from the photoreceptor drum 12 to the intermediate transfer belt 20 and the combined resistance value of the photoreceptor drum 12, intermediate transfer belt 20, and primary transfer roller 26 is previously stored in the storage device such as ROM 62 or NVM 66, and the information corresponding to the accumulative transfer amount of toner image transferred from the photoreceptor drum 12 to the intermediate transfer belt 20 is read from the storage device to obtain the combined resistance value indicated by the information. In another estimation method, information indicating a correspondence relationship between a physical quantity (for example, an operating time of the intermediate transfer belt 20) indicating the accumulative transfer amount of toner image transferred from the photoreceptor drum 12 to the intermediate transfer belt 20 and the combined resistance value of the photoreceptor drum 12, intermediate transfer belt 20, and primary transfer roller 26 is previously stored in the storage device such as ROM 62 or NVM 66, and the information corresponding to the physical quantity indicating the accumulative transfer amount of toner image transferred from the photoreceptor drum 12 to the intermediate transfer belt 20 is read from the storage device to obtain the combined resistance value indicated by the information.

In Step 109, the transfer power supply 28 is controlled such that the electric power corresponding to the combined resistance value estimated in Step 108 is supplied to the primary transfer roller 26. In Step 109, the electric power corresponding to the combined resistance value estimated in Step 108 is supplied to the primary transfer roller 26. Alternatively, the electric power may be supplied to the primary transfer roller 26 according to the physical quantity (for example, the accumulative transfer amount of toner image or the operating time of the intermediate transfer belt 20) corresponding to the combined resistance value.

In Step 110, it is determined whether or not the combined resistance value estimated in Step 108 reaches the predetermined combined resistance value. When the combined resistance value estimated in Step 108 reaches the predetermined combined resistance value, the flow goes to Step 120. When the combined resistance value estimated in Step 108 does not reach the predetermined combined resistance value, the flow goes to Step 112.

In Step 112, the resistance value measuring unit 76 measures the combined resistance value of the photoreceptor drum 12, intermediate transfer belt 20, and primary transfer roller 26.

In Step 114, it is determined whether or not the combined resistance value measured by the resistance value measuring unit 76 in Step 112 is equal to or more than the predetermined combined resistance value. When the combined resistance value measured by the resistance value measuring unit 76 is equal to or more than the predetermined combined resistance value, the flow goes to Step 116. When the combined resistance value measured by the resistance value measuring unit 76 is lower than the predetermined combined resistance value, the flow returns to Step 108.

In Step 116, the control of the transfer power supply 28 is started such that the electric power supplied to the primary transfer roller 26 reaches the predetermined electric power earlier than the electric power supplied from the transfer power supply 28 at the present time, and such that the electric power supplied to the primary transfer roller 26 is gradually increased to the predetermined electric power (hereinafter the control is referred to as "second electric power control").

Figure 4:
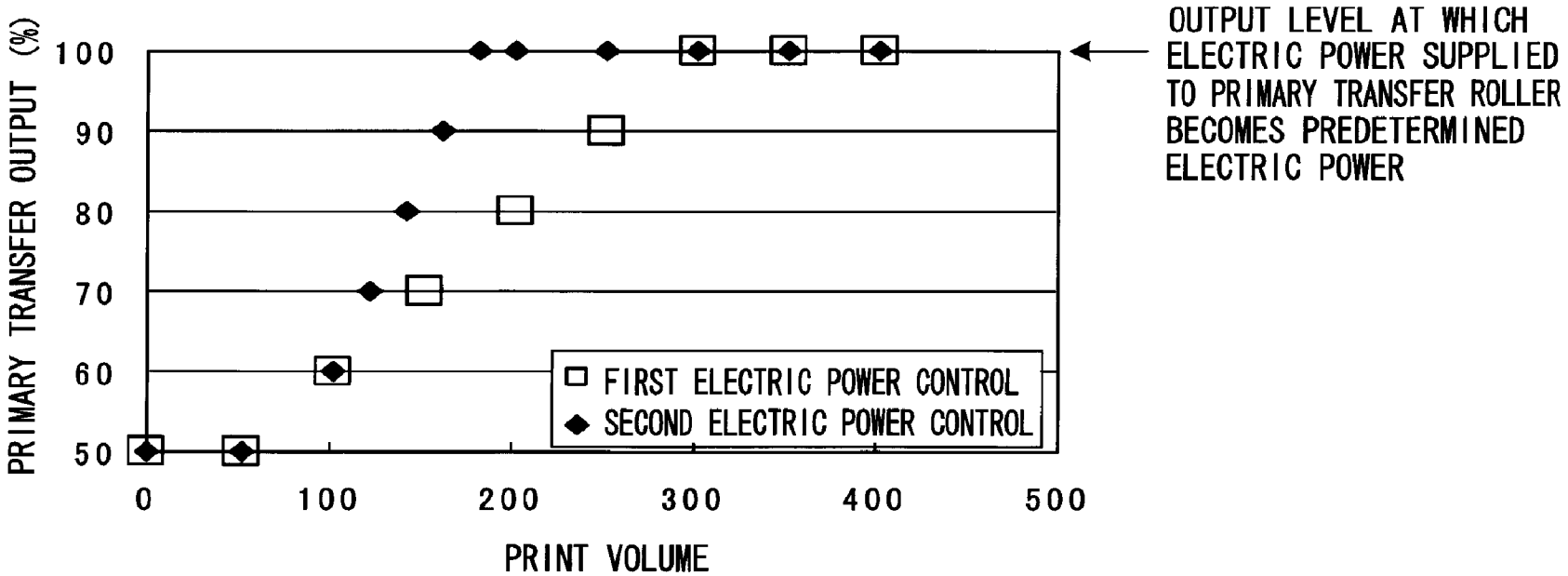
FIG. 4 is a graph illustrating an example of a relationship of an accumulative transfer amount of toner image transferred from a photoreceptor drum to an intermediate transfer belt from the beginning of a first electric power control to a transfer power supply output level in a first electric power control, or to a transfer power supply output level in a second electric power control.

FIG. 4 is a graph illustrating an example of a relationship of an accumulative transfer amount of toner image transferred from the photoreceptor drum 12 to the intermediate transfer belt 20 from the beginning of a first electric power control, to an output level of the transfer power supply 28 by the first electric power control, or to an output level of the transfer power supply 28 by the second electric power control. In FIG. 4, a horizontal axis expresses the accumulative transfer amount of toner image (indicated by "Print Volume" in FIG. 4), and a vertical axis expresses an output level (indicated by "Primary Transfer Output" in FIG. 4).

As illustrated in FIG. 4, when the transfer power supply 28 has the output level of 100%, the electric power supplied to the primary transfer roller 26 becomes the predetermined electric power. In both the first electric power control and the second electric power control, the output level of the transfer power supply 28 is gradually increased in a stepwise manner from 50% to 100%. In the second electric power control, the output level of the transfer power supply 28 is gradually increased in the stepwise manner at time intervals shorter than that of the first electric power control so as to reach the predetermined electric power earlier than the first electric power control.

FIG. 4 also illustrates an example of the case in which a transition is made from the first electric power control to the second electric power control when the accumulative transfer amount of toner exceeds "100". This is because the combined resistance value measured by the resistance value measuring unit 76 is equal to or more than the predetermined combined resistance value when the accumulative transfer amount of toner exceeds "100". For example, when the combined resistance value measured by the resistance value measuring unit 76 is equal to or more than the predetermined combined resistance value at the time the accumulative transfer amount of toner reaches "200" or "300", the transition is made at that time from the first electric power control to the second electric power control.

In Step 118, the process waits until the condition that the electric power supplied to the primary transfer roller 26 reaches the predetermined electric power is satisfied, and thereafter the flow goes to Step 120.

The condition that the electric power supplied to the primary transfer roller 26 reaches the predetermined electric power is used in Step 118. Alternatively, for example, the condition that the accumulative transfer amount of toner image transferred from the photoreceptor drum 12 to the intermediate transfer belt 20 reaches the predetermined accumulative transfer amount or the condition that the physical quantity (for example, the operating time of the intermediate transfer belt 20) indicating the accumulative transfer amount of toner image transferred from the photoreceptor drum 12 to the intermediate transfer belt 20 reaches a predetermined threshold may be used.

In Step 120, the control is performed such that the first electric power control is ended when the first electric power control is performed, and the control is performed such that the second electric power control is ended when the second electric power control is performed. Then the transfer defect suppressing process program is ended.

Although the exemplary embodiment of the invention is described above, the technical scope of the invention is not limited to the exemplary embodiment. Various changes and modifications can be made without departing from the gist of the invention, and the modes with such changes and modifications are included in the technical scope of the invention.

The invention is not limited to the exemplary embodiment, and all the combinations of features described in the exemplary embodiment are not necessary for the solving means of the invention. The exemplary embodiment includes the inventions of various stages, and various inventions can be extracted by a combination of the plural disclosed constituents depending on the situation. Even if some constituents are neglected from all the constituents described in the exemplary embodiment, the configuration in which some constituents are neglected can be extracted as the invention as long as the effect of the invention is obtained.

For example, in the exemplary embodiment, the combined resistance value of the photoreceptor drum 12, intermediate transfer belt 20, and primary transfer roller 26 is estimated based on the accumulative transfer amount of toner image transferred from the photoreceptor drum 12 to the intermediate transfer belt 20. Alternatively, the combined resistance value of the photoreceptor drum 12, intermediate transfer belt 20, and primary transfer roller 26 may be estimated based on at least one of the temperature measured by the temperature sensor 42 and the humidity measured by the humidity sensor 44.

As to the estimation method in this case, information indicating a correspondence relationship between at least one of the temperature and humidity in the space of the image forming apparatus 10 and the combined resistance value of the photoreceptor drum 12, intermediate transfer belt 20, and primary transfer roller 26 is previously stored in ROM 62 or NVM 66, and the combined resistance value is estimated using the information.

In the exemplary embodiment, the combined resistance value is estimated and the first electric power control is ended when the estimated combined resistance value becomes the predetermined combined resistance value. Alternatively, the first electric power control may be ended when the combination of the temperature measured by the temperature sensor 42 and the humidity measured by the humidity sensor 44 becomes a predetermined combination.

Assuming that the combined resistance value of the photoreceptor drum 12, intermediate transfer belt 20, and primary transfer roller 26 becomes the predetermined combined resistance value, a combination of the temperature and the humidity previously obtained from the experiment in which the real machine of the image forming apparatus 10 is used or the computer simulation based on design specifications of the image forming apparatus 10 is used as the predetermined combination.

In the exemplary embodiment, the electric power supplied to the primary transfer roller 26 is gradually increased in a stepwise manner to a predetermined electric power from an electric power smaller than the predetermined electric power. Alternatively, the electric power supplied to the primary transfer roller 26 may continuously gradually be increased to a predetermined electric power from an electric power smaller than the predetermined electric power.

In the exemplary embodiment, transfer power supply 28 is controlled such that the electric power supplied to the primary transfer roller 26 is gradually increased to a predetermined electric power from an electric power smaller than the predetermined electric power. The electric power supplied to the secondary transfer roller 38 may similarly be controlled.

In the exemplary embodiment, it is determined whether or not the estimated combined resistance value reaches the predetermined combined resistance value. Alternatively, it may be determined whether or not the physical quantity (in this case, the accumulative transfer amount of toner image transferred from the photoreceptor drum 12 to the intermediate transfer belt 20) corresponding to the combined resistance value reaches a predetermined physical quantity (in this case, a predetermined accumulative transfer amount of toner image). Assuming that the combined resistance value of the photoreceptor drum 12, intermediate transfer belt 20, and primary transfer roller 26 becomes the predetermined combined resistance value, a value previously obtained from the experiment in which the real machine of the image forming apparatus 10 is used or the computer simulation based on design specifications of the image forming apparatus 10 is used as the predetermined accumulative transfer amount of toner image.

In the exemplary embodiment, the rotary-type development device 18 is used to superimpose the Y, M, C, and K toner images. Alternatively, the development section that forms the Y toner image, the development section that forms the M toner image, the development section that forms the C toner image, and the development section that forms the K toner image may be arranged along the outer circumferential surface of the photoreceptor drum 12. Y, M, C, and K image forming units each of which includes the development section, the photoreceptor drum 12, the charger 14, the laser beam scanning device 16, and the erasing and cleaning device 22 may be arranged in parallel on the intermediate transfer belt 20.

The configuration (see FIG. 1) of the image forming apparatus 10 of the exemplary embodiment is described only by way of example. The configuration of the image forming apparatus 10 of the exemplary embodiment may be changed without departing from the scope of the invention depending on the situation.

The process flow (see FIG. 3) of the transfer defect suppressing process program described in the exemplary embodiment is also only by way of example. The unnecessary step may be neglected, a new step may be added, or a process sequence may be changed without departing from the scope of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries a developed image that has been developed on a surface thereof using a developer;

a transfer member that transfers the developed image from the image carrier to a belt-shaped member;

an electric power supply unit that supplies electric power to the transfer member;

a measurement unit that measures a combined resistance value of the image carrier, the belt-shaped member, and the transfer member; and a controller that controls the electric power supply unit such that the electric power supplied to the transfer member is changed from a predetermined first supply value to a second supply value, the second supply value being larger than the first supply value, when the combined resistance value measured by the measurement unit is lower than a predetermined combined resistance value.

2. The image forming apparatus of claim 1, wherein the predetermined combined resistance value is set in accordance with a condition under which a discharge product adhering to a backside of the belt-shaped member deliquesces.

3. The image forming apparatus of claim 1, wherein the measurement unit measures the combined resistance value while the controller controls the electric power supply unit until the supply value supplied to the transfer member changes to the second supply value from the first supply value, and the controller controls the electric power supply unit such that the supply value is increased when the combined resistance value measured by the measurement unit becomes equal to or more than the predetermined combined resistance value.

4. The image forming apparatus of claim 1, further comprising an estimation unit that estimates the combined resistance value, wherein the controller controls the supply value supplied to the electric power supply unit between the first supply value and the second supply value according to the combined resistance value estimated by the estimation unit.

5. The image forming apparatus of claim 4, further comprising a physical quantity measuring unit that measures a physical quantity corresponding to an accumulative transfer amount of developed image transferred from the image carrier to the belt-shaped member, wherein the estimation unit estimates the combined resistance value based on the physical quantity measured by the physical quantity measuring unit.

6. The image forming apparatus of claim 4, further comprising an environmental condition measuring unit that measures at least one of temperature and humidity in a space inside the apparatus, wherein the estimation unit estimates the combined resistance value based on the measurement result of the environmental condition measuring unit.

7. The image forming apparatus of claim 6, wherein the estimation unit estimates the combined resistance value based on the measurement result of the environmental condition measuring unit when the result includes at least one of a relatively high temperature and a relatively high humidity.

* * * * *